US007260339B2

(12) United States Patent
Carter et al.

(10) Patent No.: US 7,260,339 B2
(45) Date of Patent: Aug. 21, 2007

(54) FUSER UNIT OPERATION FOR GLOSS CONSISTENCY

(75) Inventors: Daniel Lee Carter, Georgetown, KY (US); John William Kietzman, Lexington, KY (US); Calvin Dale Murphy, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 279 days.

(21) Appl. No.: 10/809,170

(22) Filed: Mar. 25, 2004

(65) Prior Publication Data

US 2005/0214011 A1 Sep. 29, 2005

(51) Int. Cl.
*G03G 15/20* (2006.01)

(52) U.S. Cl. ..... 399/68; 399/70; 399/364; 399/401

(58) Field of Classification Search ..... 399/68, 399/67, 69, 70, 364, 401, 400
See application file for complete search history.

(56) References Cited

U.S. PATENT DOCUMENTS

| | | | | |
|---|---|---|---|---|
| 5,659,846 | A * | 8/1997 | Yoshioka | 399/364 |
| 6,253,046 | B1 * | 6/2001 | Horrall et al. | |
| 2003/0081962 | A1 * | 5/2003 | Murata | 399/69 |
| 2003/0235449 | A1 * | 12/2003 | Ahn | 399/401 |
| 2004/0037601 | A1 * | 2/2004 | Uchida et al. | 399/401 |
| 2005/0025511 | A1 * | 2/2005 | Watabe | 399/67 |

* cited by examiner

*Primary Examiner*—David M. Gray
*Assistant Examiner*—Laura K Roth
(74) *Attorney, Agent, or Firm*—Taylor & Aust, P.C.

(57) ABSTRACT

A method of operating a fuser for duplex printing includes equilibrating the fuser roll surface temperatures by rotating the rolls at a speed faster than the process speed between fusing an image on a first side of the media and fusing an image on a second side of the media.

22 Claims, 2 Drawing Sheets

FUSER UNIT OPERATION FOR GLOSS CONSISTENCY

BACKGROUND OF THE INVENTION

1. Field of the Invention

The present invention relates generally to electrophotographic printing devices and, more particularly, to methods for operating the fuser in electrophotographic printing devices to reduce gloss discontinuity during duplex printing.

2. Description of the Related Art

In the electrophotographic (EP) imaging process used in printers, copiers and the like, a photosensitive member, such as a photoconductive drum or belt, is uniformly charged over an outer surface. An electrostatic latent image is formed by selectively exposing the uniformly charged surface of the photosensitive member. Toner particles are applied to the electrostatic latent image, and thereafter the toner image is transferred to the media intended to receive the final permanent image. The toner image is fixed to the media by the application of heat and pressure in a fuser.

A fuser is known to include a heated roll and a backup roll forming a fuser nip through which the media passes. During the fusing process, it is necessary that sufficient heat be applied to the toner particles so that the toner is permanently affixed to the media. Adequate fusing temperatures are quite high, and even relatively minor variations in the temperature around the circumference of the heated roll can alter the gloss appearance of the final image. Therefore, it is necessary to maintain the heated roll at a substantially consistent temperature over the entire surface thereof. If a portion of the media-contacting surface of the heated roll is cooler than other portions, the image on the media can have visually noticeable dull spots that are less glossy than other areas that received higher temperature during fusing. When the hot roll and backup roll are turned continuously, the surfaces thereof retain substantially consistent temperatures around the circumferences of each. Maintaining substantially consistent surface temperatures becomes more difficult as process speeds increase and there is less time for temperature equilibration between fusing operations on successive pieces of media.

To reduce printer size and cost while retaining high output performance, it is known to use printer architecture in which duplex routing includes passing the media nearly into the output bin before rapidly withdrawing the media back into the duplex path for imaging the second side. Two motors can be used, one to operate the fuser in the process direction, and a second to drive the output rolls in reverse to withdraw the sheet from the output area. To further reduce machine costs, a single reversible fuser motor can be used. For duplexing, the motor is reversed from the normal process direction when the media is withdrawn from the output area and directed to the duplex path. Since duplex routing essentially is "dead time" during which no fusing operation occurs, it is desirable to reduce the time required to reverse the sheet to a period as short as possible. Therefore, during duplex routing, it is desirable to operate the motor at higher speed than normal process speed. This can be accomplished by using a motor of sufficient size to reverse quickly and drive all fuser components at a faster speed in reverse than in the normal process direction. However, this adds significant cost for a larger motor that is required for a brief time only, and only when duplex printing is used.

It is proposed to disengage the fuser rolls when the motor is reversed, thereby decreasing the load inertia on the motor, and allowing the motor to reverse more quickly and thereby increase duplex throughput. A suitable structure for disengaging the fuser rolls is a swing arm assembly that disengages the hot roll gear from the fuser drive train when the motor is reversed. However, when the heated roll and the pressure roll are stopped in contact with each other, significant heat transfer occurs through the nip, from the hot roll to the backup roll. As a result, a cold spot occurs on the hot roll, which can cause horizontal bands of gloss discontinuity on the printed media. Since the change in gloss is relatively abrupt, it can be noticeable on solid images particularly.

It is known to use so called multi-mode duplexers that can alter the manner in which duplex printjobs are performed. In a three-image duplexer, three pages are in the paper path at one time. In a two-image duplexer, two pages are present in the paper path at one time. In a one-image duplexer, only a single page is in the paper path at any time. A multi-mode duplexer can switch between various multi-image processes or to a one-image process, in response to the complexity of the images and the amount of memory available.

What is needed in the art is an operating process to improve temperature consistency around the circumference of the fuser rolls.

SUMMARY OF THE INVENTION

The present invention provides a duplex imaging mode that allows the fuser rolls to spin and become more thermally consistent between reversal of the media and imaging the second side.

The invention comprises, in one form thereof, a method of operating a fuser unit for duplex printing by operating the drive motor at a first process speed in a first direction for fusing an image on a first side of the media; reversing the direction of operation of the motor to begin duplex routing of the media; re-reversing the direction of operation of the motor while the media is routed back to the nip formed between the hot roll and the backup roll; and operating the motor at a speed greater than the first process speed for a time while routing the media back to the nip formed between the hot roll and the backup roll.

The invention comprises, in another form thereof, a method of operating a fuser unit for duplex printing by operating a drive motor at a first process speed in a first direction for fusing an image on a first side of the media; stopping rotation of the hot roll and the backup roll after fusing an image on the first side of the media; resuming rotation of the hot roll and the backup roll before advancing the media between the hot roll and the backup roll for fusing an image on the second side of the media; and operating the motor at a speed greater than the first process speed after resuming rotation, and thereby improving the thermal consistency of the roll surfaces.

In still another form thereof, the invention provides a method for operating a fuser unit for duplex printing. The fuser motor is operated at a first process speed in a first direction for fusing an image on a first side of the media. The hot roll is disengaged from the fuser drive train after fusing the image on the first side of the media. The hot roll is re-engaged with the drive train; and the fuser motor is operated at a speed greater than the first process speed after the hot roll is re-engaged with the drive train to improve the thermal consistency of the roll surfaces.

An advantage of the present invention is providing improved print quality.

Another advantage is providing improved temperature uniformity around the circumference of fuser rolls, which provides improved gloss uniformity on the final image.

A further advantage of the present invention is providing a printer with high output performance and print quality in a compact design at reduced manufacturing cost.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Testing has shown that fuser roll surface temperatures become more uniform based more on the number of revolutions of the rolls than on the time during which the revolutions occur. As a result, increasing the number of revolutions of the rolls during a given time period is more effective in improving the surface temperature uniformity than is increasing the time allowed for improving temperature uniformity.

To demonstrate the dependence of temperature uniformity on the number of revolutions rather than the duration of the revolutions, tests were performed. The tests created a hot spot on the hot roll rather than a cool spot like those that cause gloss defects in an actual printing operation. The process of eliminating a hot spot via roll rotation is the same as that for eliminating a cool spot.

The tests were performed by bringing a fuser hot roll from a cold start to its operating temperature, with the hot roll and backup roll remaining stationary. This condition was maintained until the backup roll heated to a sufficiently high temperature that the nip region between the rolls created a hot spot on the hot roll. Heat loss by conduction to the backup roll was less than the heat loss by convection to the cool ambient air surrounding the hot roll outside of the nip, creating the hot spot in the nip. The rolls were then rotated suddenly at a process speed of twenty pages per minute. The test was repeated, with the rolls rotated at a process speed of ten pages per minute.

A thermistor was positioned outside the roll nip and measured the surface temperature of the rotating hot roll. Each passing of the localized hot spot created in the nipped region when the rolls were not rotating was measured as a temperature peak that decreased with each passing. These peaks in temperature were compared to the lowest temperature recorded since the previous temperature peak, and were recorded as the "Hot-Spot Temperature Rise" (H-S T.R.). The following results were obtained, comparing the succession of hot-spot temperatures rises:

TABLE 1

Hot Spot Decay With Rolls Turning at 20 ppm process speed

| Peak # | Time (sec.) Since Roll Start | H-S T.R (° C.) |
|---|---|---|
| 1 | 0.76 | 2.8 |
| 2 | 1.78 | 0.7 |
| 3 | 2.86 | 0.5 |
| 4 | 3.98 | 0.5 |
| 5 | 5.08 | 0.8 |
| 6 | 6.26 | 0.6 |
| 7 | 7.28 | 0.5 |
| 8 | 8.34 | 0.5 |
| 9 | 9.54 | 0.5 |
| 10 | 10.56 | 0.5 |

TABLE 2

Hot Spot Decay With Rolls Turning at 10 ppm process speed

| Peak # | Time (sec.) Since Roll Start | H-S T.R (° C.) |
|---|---|---|
| 1 | 1.26 | 3.4 |
| 2 | 3.52 | 1.2 |
| 3 | 5.70 | 1.1 |
| 4 | 7.94 | 0.8 |
| 5 | 10.18 | 0.8 |

The data shows that the hot spots damped more quickly when the rolls turned at a twenty page per minute process speed than when the rolls turned at a ten page per minute process speed.

Figure 1:
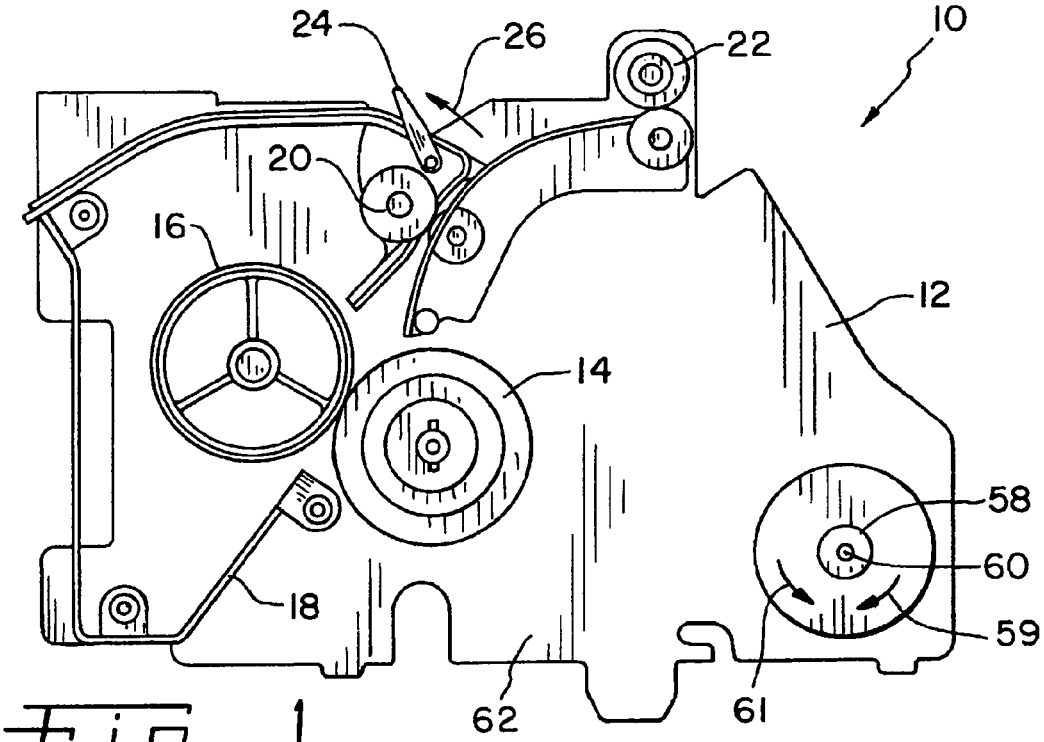
FIG. 1 is a side elevational view of a fuser unit that can be operated in accordance with the present invention, shown with the gear train removed for clarity.

Referring now to the drawings and particularly to FIG. 1, there is shown an embodiment of a fuser unit 10 for an electrophotographic (EP) printing device in which the present invention can be applied. Fuser unit 10 can be adapted for use in a printer, copier or other printing device using the electrophotographic process requiring a fuser unit to permanently adhere toner particles to the media being printed. Fuser unit 10 can be provided for use in a color printing device or a monochrome printing device.

Fuser unit 10 includes a frame 12 consisting of a variety of substantially rigid members such as plates, bars and the like securely affixed to one another to form a substantially rigid supporting structure for the remaining components of fuser 10. Frame 12 is adapted for mounting in the printing device, and may be provided as a customer replaceable unit (CRU), or a field replaceable unit (FRU). The features of the present invention also can be used in a fuser integrated directly into the machine frame.

In general, fuser unit 10 includes a hot roll 14 heated in known manner, such by a lamp within roll 14. A backup roll 16 is disposed in nipped relationship to hot roll 14, and heat and pressure are applied to media passing through the nip formed between hot roll 14 and backup roll 16. Hot roll 14 and backup roll 16 are metal, such as aluminum, and have a cover of an elastomer, which can be a silicone rubber covered by a PFA sleeve. A media path defined by an entry guide member 18 directs media between hot roll 14 and backup roll 16. An exit path includes one or more exit rolls 20 from the fusing nip and output rolls 22 from fuser 10, which are driven. In the exemplary embodiment shown in the drawings, fuser unit 10 includes a sensor flag/diverter assembly 24 for a duplexing path indicated by arrow 26 to provide imaging on both sides of media processed through fuser unit 10.

Figure 2:
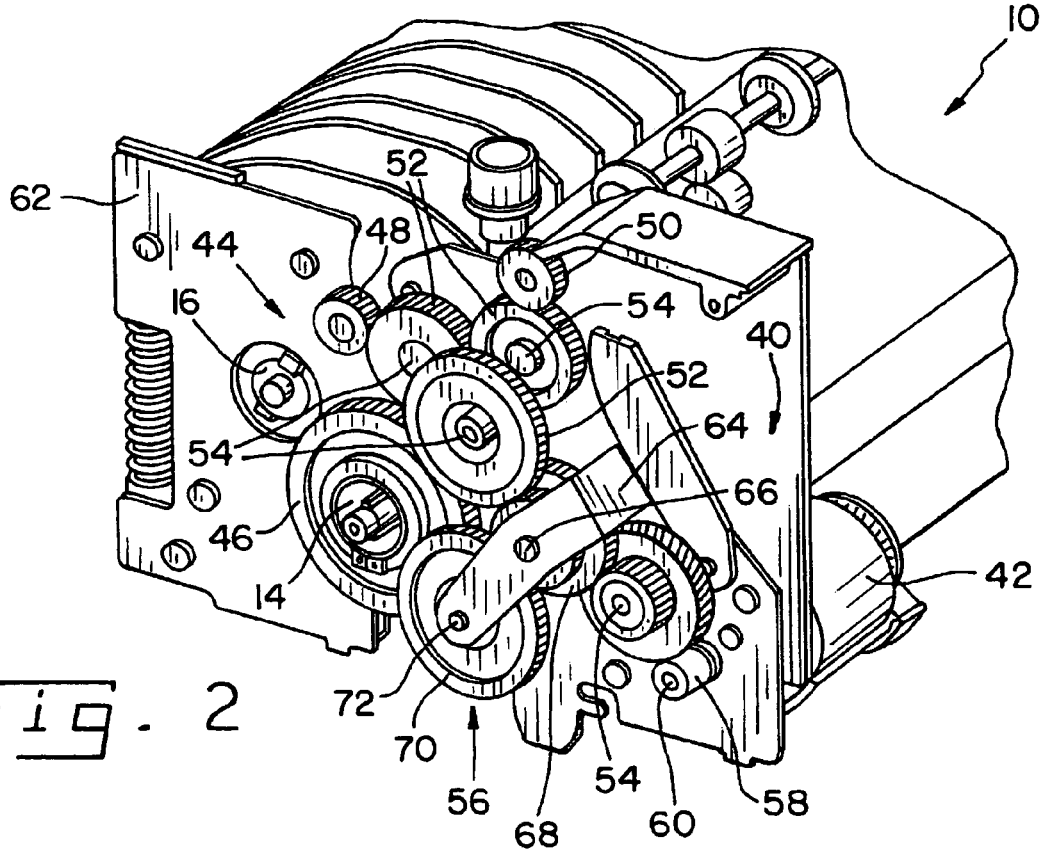
FIG. 2 is a perspective view of the fuser unit shown in FIG. 1, shown with the drive train in place.

With reference now to FIG. 2, a fuser unit drive system 40 is shown for driving hot roll 14 and the various other driven rolls and components of fuser 10. Drive system 40 includes a fuser motor 42 mounted to fuser frame 12 and operatively connected to a drive train 44. While the exemplary embodiment of drive train 44 shown in the drawings is a gear train 44, those skilled in the art will understand that drive train 44 can include a series of interconnected gears, a belt drive system of belts and pulleys or a combination of belts, pulleys and gears. As used herein, the term "drive train" is intended to include such variations, and individual elements such as gears, pulleys or belts of the drive train shall be referred to collectively as components of the drive train.

Drive train 44 includes a hot roll gear 46 connected to hot roll 14 for rotating hot roll 14, an exit drive gear 48 connected to driven exit roll 20 for driving exit roll 20, and an output drive gear 50 connected to driven output roll 22, for driving output roll 22. A variety of additional gears 52 in drive train 44 are provided for rotating other components of the printing device or as idling gears on studs 54 in fuser housing 12, for speed and rotational directional control and adjustment in drive train 44. Additional gears 52 can be of different gear types, as necessary, including both single and compound gears rotatably mounted on studs 54.

A swing arm assembly 56 is incorporated into drive system 40 and functions as a clutch to engage and disengage hot roll gear 46 from drive train 44, as will be described more fully hereinafter. Drive system 40, including drive motor 42, drive train 44 and swing arm assembly 56, is fully integrated into fuser unit 10, carried by fuser frame 12. As a result, installation and removal requires only making and breaking electrical connections to fuser unit 10 from the base machine, in addition to completing physical attachment of the fuser unit in the base machine.

Figure 3:
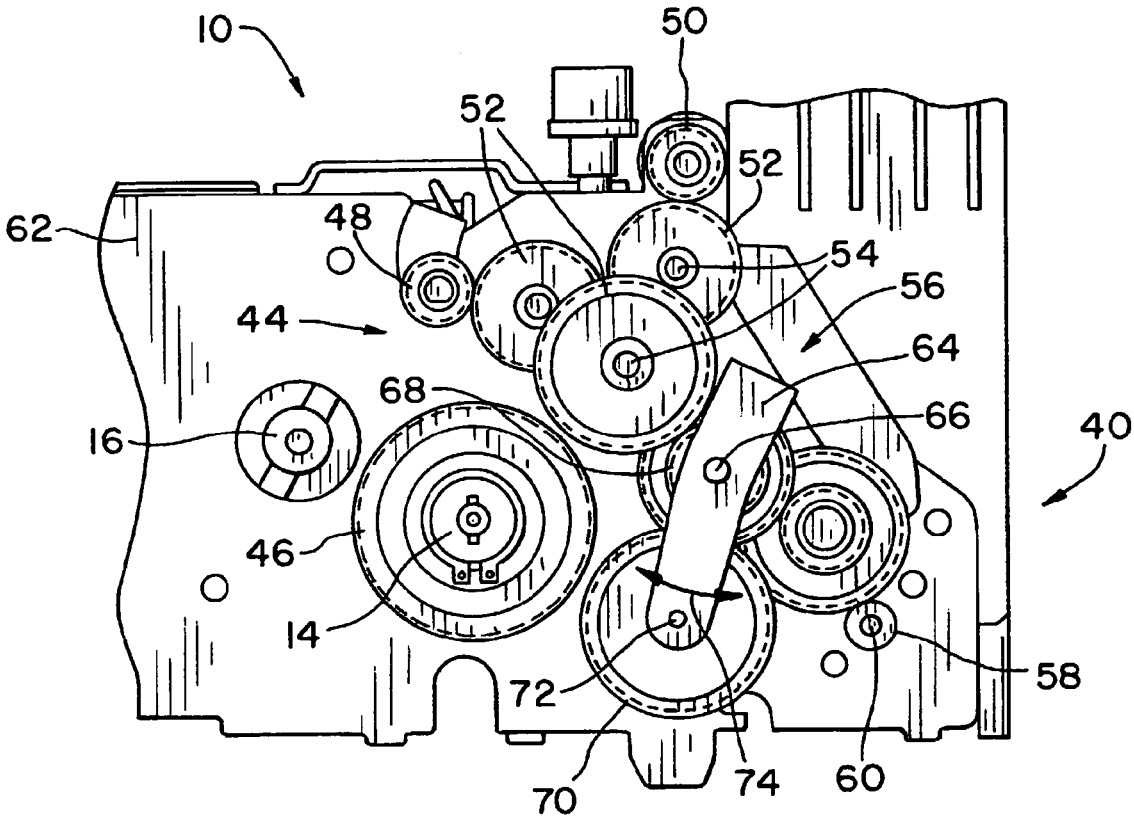
FIG. 3 is a fragmentary side elevational view of the fuser unit, illustrating bi-directional swing arm movement of the fuser unit.

Fuser motor 42 is a bi-directional DC motor with encoder feedback for velocity control. Motor 42 includes a pinion gear 58 on motor shaft 60, which rotates in a first direction 59 for normal printing and in the opposite direction 61 for duplex processing. FIG. 2 illustrates the condition of drive system 40 during normal printing, with motor shaft 60 being rotated in a clockwise direction with respect to the perspective shown for fuser 10. FIG. 3 illustrates the condition of drive system 40 during duplex routing, with motor shaft 60 being rotated in a counter-clockwise direction with respect to the perspective shown for fuser 10.

Advantageously, motor shaft 60 and all gears of drive train 44 are located positionally by a side plate 62 of frame 12, so that center distances between gears are easily established and well controlled. All gear stud, roll shaft and other locating holes can be punched in plate 62 at the same time from a single die to provide precisely located positions with respect to one another. Gear centers are located precisely with respect to each other, facilitating the use of fine pitched, plastic gears commonly used in printers and copiers. The potential for gear breakage, gear noise, premature wear of the gears and inconsistent performance is reduced.

Swing arm assembly 56 includes a bracket 64 rotatably connected about a pivot 66. A primary gear 68 of assembly 56 is rotatably mounted to plate 62 through pivot 66, and is continuously engaged in drive train 44, to be driven in both clockwise and counterclockwise directions. Primary gear 68 is drivingly engaged with a speed adjusting gear 70 that is rotatable relative to bracket 64 through a stud 72. A compound drive gear (not shown) inwardly of gear 70 on stud 72 can be engaged with and disengaged from hot roll gear 46 upon movement of bracket 64 about pivot 66. Internal friction within swing arm assembly 56, such as between bracket 64, gear 70 and/or pivot 66 cause pendulum-like movement of bracket 64 about pivot 66, as indicated by arrow 74.

In the normal printing mode, with motor 42 rotating clockwise, bracket 64 is rotated clockwise about pivot 66 and is positioned toward hot roll gear 46, which is engaged in drive train 44 for rotation of hot roll 14. Operation in this manner continues as media passes between hot roll 14 and backup roll 16. If only single side printing is required, normal printing mode continues from one piece of media to the next, until the print job is complete.

During a duplex printing operation, after a first side of the media has been printed, rotation at the normal process speed and direction continues until the media has almost left fuser unit 10. Before the media completely leaves fuser unit 10, the rotational direction of motor 42 is reversed. As motor 42 begins rotating in a counterclockwise direction, the rotational direction of primary gear 68 is reversed, and the internal friction between the components of swing arm assembly 56 causes bracket 64 to rotate counterclockwise about pivot 66 and swing away from hot roll gear 46. Bracket 64 moves sufficiently to disengage hot roll gear 46 from drive train 44. At the same time, output rolls 22 are reversed, to pull the media back into duplexing path 26.

When the media has been pulled back into fuser 10 far enough to clear output rolls 22, the direction of rotation of motor 42 is again reversed, to then again be in the normal process direction for fusing the media on the second side. With motor 42 rotating clockwise, bracket 64 is rotated clockwise about pivot 66 and is moved toward hot roll gear 46, which is re-engaged with drive train 44 for rotation of hot roll 14. Operation in this manner continues as media passes through the duplexing path ultimately to pass again between hot roll 14 and backup roll 16.

By disengaging hot roll gear 46 from drive train 44 at the start of the duplex function, neither hot roll 14 nor backup roll 16 is turned by fuser motor 42 during the two reversals in the direction of rotation for fuser motor 42. The resultant reduction in load on motor 42 allows motor 42 to be reversed quickly, without requiring a larger, more expensive motor to overcome inertia loads from the fuser rolls. Fuser exit drive gear 48 and output drive gear 50 are direct driven through a separate branch of drive train 44 from hot roll gear 46, and are continuously connected and driven by motor 42, in both directions of motor rotation. This allows for substantially instantaneous direction changes in the output rolls, improving duplex efficiency compared to designs requiring engagement and disengagement of the output rolls for direction reversal.

The present invention alters the operation of motor 42 when motor 42 is reversed the second time during a duplex print job, that is when motor 42 is returned to forward rotation from the reverse rotation required to draw the media back into the fuser. As described above, during the second reversal by motor 42, hot roll gear 46 is re-engaged in drive train 44 and begins to rotate. While motor 42 was operated in the direction opposite the process direction, hot roll 14 and backup roll 16 remained in nipped relation, but were not turning. As a result, hot and cold spots will have formed within and outside of the nipped area.

Motor 42 is rotated in the process direction, but at greater than the desired process speed while the media is being routed through the machine before being fused. That is, while the media is proceeding along the media path to be repositioned for second side imaging and then imaged on the second side, fuser motor 42 is operated at greater than the desired process speed. Desirably, motor 42 is operated at its maximum rotational speed to achieve the most rotations possible in the available time. Motor 42 is returned to the desired process speed in time for hot roll 14 and backup roll 16 to slow to process speed before the media passes therebetween.

To provide the desired speed in excess of the target process speed, motor 42 can be provided of slightly larger size. In a printer, motor 42 simply can be operated at a faster process speed than otherwise required. Another aspect of the present invention halts the media in single-image duplex mode while it is being repositioned for second side imaging, so that the fuser motor can achieve more rotations before the media passes between the fuser rolls to fuse the image on the second side. In this way, the fuser roll surface temperature can be made even more uniform than permitted by normal duplex timing.

The operating principles of the present invention can be used in single mode or multi-mode duplexers, and are particularly advantageous for use in a multi-mode duplexer operated in a one-image mode, with a single piece of media in the media path. However, the present invention also can be used for a duplexer operated in a two-image mode, with two pieces of media in the media path, or a duplexer operated in a three-image mode, with three pieces of media in the media path.

Another aspect of the present invention to reduce gloss discontinuities during duplex printing involves preheating the backup roll. By preheating the backup roll before a duplex print job, the temperature differential across the fuser nip is reduced, and less heat will transfer between the rolls while the rolls are stopped. Preheating can be accomplished by turning the rolls longer before the start of a duplex print job.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of operating a fuser unit for duplex printing, comprising:

providing a hot roll and a backup roll in nipped relation, and a drive system including a drive motor for causing the rotation of the rolls;

operating the motor at a first process speed in a first direction for advancing media between the hot roll and backup roll for fusing an image on a first side of the media;

reversing the direction of operation of the motor to begin duplex routing of the media by operating the motor in an opposite direction from the first direction;

re-reversing the direction of operation of the motor while media is routed back to the nip formed between the hot roll and the backup roll before the media leaves the fuser unit;

disengaging the hot roll and the backup roll from the drive system during the reversing step, said re-reversing step occurring when the media has been pulled back into the fuser unit far enough to clear a set of output rolls of the fuser unit; and operating the motor at a speed greater than the first process speed for a time to drive the hot roll while the media is being routed back to the nip formed between the hot roll and the backup roll.

2. The method of claim 1, said step of operating the motor at a speed greater than the first process speed being performed by operating the motor at a speed of about twice the first process speed.

3. The method of claim 1, said fuser having a second process speed greater than the first process speed, and said step of operating the motor at a speed greater than the first speed being performed by operating the motor at the second process speed.

4. The method of claim 3, said step of operating the motor at a speed greater than the first process speed being performed by operating the motor at a speed of about twice the first speed.

5. The method of claim 1, said fuser being operated in a one-image mode.

6. The method of claim 5, said step of operating the motor at a speed greater than the first process speed being performed by operating the motor at a speed of about twice the first process speed.

7. The method of claim 5, including the additional step of stopping the media during duplex routing.

8. The method of claim 1, said fuser being operated in a two-image mode.

9. The method of claim 8, said step of operating the motor at a speed greater than the first process speed being performed by operating the motor at a speed of about twice the first process speed.

10. The method of claim 1, including preheating the backup roll before said step of operating the motor at a first process speed in a first direction for advancing media between the hot roll and backup roll for fusing an image on a first side of the media.

11. The method of claim 10, said preheating performed by rotating the hot roll and the backup roll at greater than the first process speed.

12. The method of claim 1, further comprising the step of re-engaging the hot roll and the backup roll with the drive system during the re-reversing step.

13. A method of operating a fuser unit for duplex printing, comprising:

providing a hot roll and a backup roll in nipped relation, and a drive system including a drive motor for causing the rotation of the rolls;

operating the motor at a first process speed in a first direction for advancing media between the hot roll and backup roll for fusing an image on a first side of the media;

stopping rotation of the hot roll and the backup roll after fusing an image on a first side of the media while the drive motor rotates, said stopping rotation step occurring before the media leaves the fuser unit;

resuming rotation of the hot roll and the backup roll before advancing the media between the hot roll and the backup roll for fusing an image on a second side of the media, said resuming rotation step occurring when the media has been pulled back into the fuser unit far enough to clear a set of output rolls of the fuser unit; and operating the motor at a speed greater than the first process speed to drive the hot roll after said resuming rotation step while the media is apart from the fuser unit.

14. The method of claim 13, said step of operating the motor at a speed greater than the first process speed being performed by operating the motor at a speed of about twice the first process speed.

15. The method of claim 14, said fuser being operated in a one-image mode.

16. The method of claim 13, said fuser being operated in a two-image mode.

17. The method of claim 16, said step of operating the motor at a speed greater than the first process speed being performed by operating the motor at a speed of about twice the first process speed.

18. The method of claim 13, said fuser being operated in a one-image mode.

19. The method of claim 13, including preheating the backup roll before said step of operating the motor at a first process speed in a first direction for advancing media between the hot roll and backup roll for fusing an image on a first side of the media.

20. The method of claim 19, said preheating performed by rotating the hot roll and the backup roll at greater than the first process speed.

21. A method of operating a fuser unit for duplex printing, comprising:

providing a hot roll and a backup roll in nipped relation, and a drive system including a drive motor and drive train for causing the rotation of the rolls;

operating the motor at a first process speed in a first direction for advancing media between the hot roll and backup roll for fusing an image on a first side of the media;

disengaging the hot roll from the drive train after fusing an image on a first side of the media;

re-engaging the hot roll with the drive train before the media leaves the fuser unit once the media clears a set of output rolls of the fuser unit; and operating the motor at a speed greater than the first process speed to drive the hot roll after said step of re-engaging the hot roll with the drive train and before the media returns to the fuser unit.

22. The method of claim 21, said step of operating the motor at a speed greater than the first process speed being performed by operating the motor at a speed of about twice the first process speed.

* * * * *